US007661285B2

(12) United States Patent
Ho

(10) Patent No.: US 7,661,285 B2
(45) Date of Patent: Feb. 16, 2010

(54) DRAWING MACHINE

(75) Inventor: Po-Lin Ho, Chang Hua Hsien (TW)

(73) Assignee: Elite Machine and Design Ltd., Chang Hua Hsien (TW)

( * ) Notice: Subject to any disclaimer, the term of this patent is extended or adjusted under 35 U.S.C. 154(b) by 0 days.

(21) Appl. No.: 12/233,737

(22) Filed: Sep. 19, 2008

(65) Prior Publication Data

US 2009/0013542 A1 Jan. 15, 2009

Related U.S. Application Data

(63) Continuation-in-part of application No. 11/618,082, filed on Dec. 29, 2006.

(51) Int. Cl.
*B21C 1/14* (2006.01)

(52) U.S. Cl. ..... 72/290; 72/287

(58) Field of Classification Search ..... 72/274, 72/284, 287, 290, 291, 450
See application file for complete search history.

(56) References Cited

U.S. PATENT DOCUMENTS 2,664,191 A * 12/1953 May ..... 72/347
3,138,243 A 6/1964 Oakley ..... 72/290
3,690,133 A 9/1972 Hilgers ..... 72/19
3,844,152 A * 10/1974 Peytavin ..... 72/290
4,879,892 A * 11/1989 Paraskevas ..... 72/290
4,941,197 A 7/1990 Roeser ..... 384/44

OTHER PUBLICATIONS

European Patent No. 0112805, Sep. 9, 1987, 9 pages.
European Patent No. 0306608, Apr. 20, 1988, 8 pages.

* cited by examiner

*Primary Examiner*—Dana Ross
*Assistant Examiner*—Stephanie Jennings
(74) *Attorney, Agent, or Firm*—Alan Kamrath; Kamrath & Associates PA

(57) ABSTRACT

A drawing machine includes a plate unit, a clamping device, a transmit member, a driving device and a cam. The transmit member includes a following roller. The driving device includes a main linkage inserted through the plate unit and having first and second ends. The cam includes first and second cam paths, with the first cam path disposed between two sides of the second cam path. When the cam is in a first position, the distances between the first cam path and two sides of the second cam path are different. When the cam is in a second position, the distances between the first cam path and two sides of the second cam path are equal. The following roller drives the main linkage to pivot, with the clamping device driven to clamp a rod or pipe. The plate unit is driven by the second cam path and reciprocates along the cam axially.

20 Claims, 10 Drawing Sheets

DRAWING MACHINE

CROSS-REFERENCE

The present patent application is a continuation-in-part application of U.S. patent application Ser. No. 11/618,082 filed on Dec. 29, 2006.

BACKGROUND OF INVENTION

1. Field of Invention

The present invention relates to a drawing machine.

2. Related Prior Art

Referring to FIGS. 9 and 10, there is shown a conventional drawing machine 1 including a clamping device and a driving device. The clamping device includes a lower plate, two rails, two slides, two jaws 3, two rods, an upper plate, a transmit element and a cylinder 4. The rails extend on the top of the lower plate and get closer to each other from a first end to a second end. The slides are movable along the rails. The jaws 3 are carried on the slides. The rods are raised from the slides. The upper plate is attached to the lower plate. The transmit element is movable on the upper plate and connected to the rods inserted through the upper plate. The cylinder 4 is a pneumatic or hydraulic cylinder for moving the transmit element on the upper plate. The cylinder 4 can move the transmit element. The transmit element can move the rods. The rods move the slides. The slides move the jaws 3. The jaws 3 get closer to each other for clamping a bar or pipe to be drawn. The driving device includes two following rollers and a driving element 2. The following rollers are attached to the second surface of the lower plate. The driving element 2 includes a shaft and a ridge extending on the shaft and acting as a cam. The ridge is engaged with the following rollers. As the shaft is rotated, the following rollers are moved by the ridge so that the clamping device is moved. Thus, the bar or pipe is drawn. However, the conventional drawing machine is not reliable for several reasons. Firstly, it is difficult to keep the pressure of the fluid in the cylinder 4 at an intended value. Secondly, there is drag in the transmission of the fluid in the cylinder 4 and a related piping. A related circuit for controlling the cylinder 4 is vulnerable to malfunctioning.

The present invention is therefore intended to obviate or at least alleviate the problems encountered in the prior art.

SUMMARY OF THE INVENTION

According to the present invention, a drawing machine includes a first plate having first and second surfaces, a clamping device disposed onto the first surface of the first plate, a transmit member that includes a first end pivotally connected to the second surface of the first plate, a second end and a following roller disposed between the first and second ends, a driving device and a cam. The driving device includes a main linkage, a base portion, active and passive cranks, a pin-jointed unit, two cushion units, a push element and a fixed based member. The linkage has first and second ends. The first end of the linkage is fixed to the active crank, and the active crank is pivotally connected to the second end of the transmit member so that the transmit member pivots with respect to the active crank. The second end of the linkage is fixed to the passive crank, and the passive crank is pivotally connected to the pin-jointed unit. The passive crank is driven to push the pin-jointed unit to move. The pin-jointed unit is fixed to the push element, and the push element is fixed to the fixed base member, with the clamping device fixed to the fixed base member. The cam includes first and second cam paths, with the following roller of the transmit member provided in the first cam path. The first and second cam paths respectively include clamping sections and releasing sections. While the transmit member is in a first position and the following roller is disposed in the clamping section, the distances between the following roller and two sides of the second cam path are different. While the transmit member is in a second position and the following roller is disposed in the releasing section, the distances between the following roller and two sides of the second cam path are equal. The second end of the transmit member drives the linkage to pivot as to drive the second end of the linkage to control the clamping device to a clamp rod or pipe or not. The plate unit is driven by the second cam path to move reciprocatingly with respect to the cam.

An advantage of the drawing machine according to the present invention is reliability for not including any hydraulic or pneumatic cylinder that fluctuates in the pressure of the fluid and drags in transmission of the fluid.

Another advantage of the drawing machine according to the present invention is a simple structure including a small amount of elements.

Other advantages and features of the present invention will become apparent from the following description referring to the drawings.

BRIEF DESCRIPTION OF THE DRAWINGS

The present invention will be described via detailed illustration of the preferred embodiment referring to the drawings.

DETAILED DESCRIPTION OF THE PREFERRED EMBODIMENT

Figure 1:
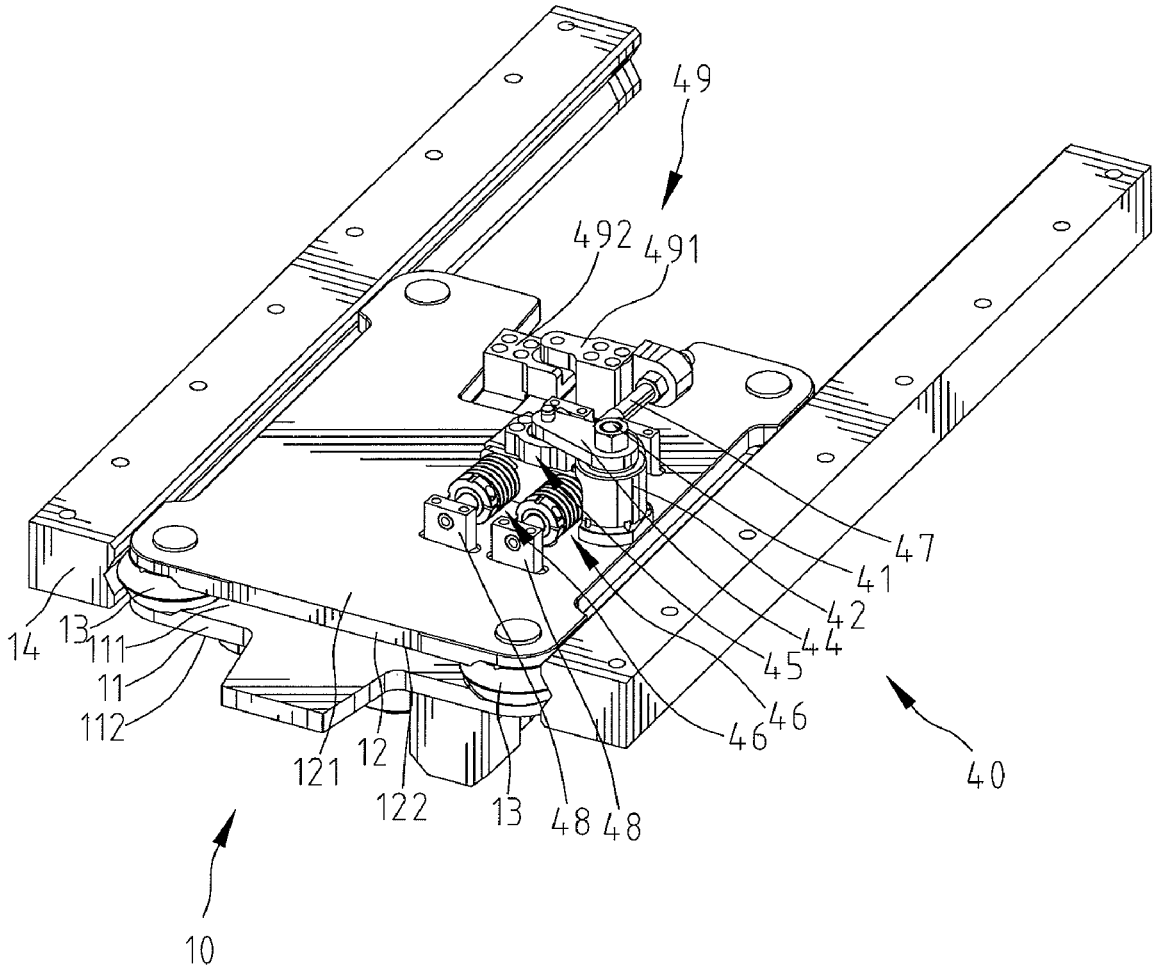
FIG. 1 is a perspective view of the top of a drawing machine according to the preferred embodiment of the present invention.
Figure 2:
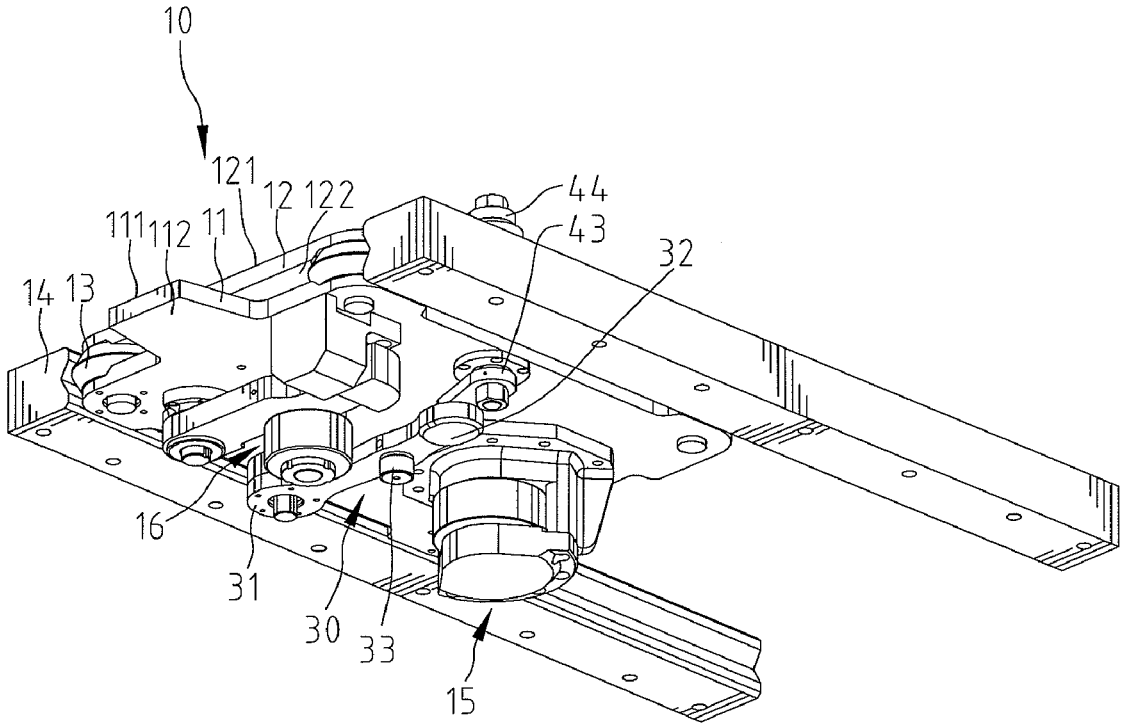
FIG. 2 is a perspective view of the bottom of the drawing machine shown in FIG. 1.
Figure 3:
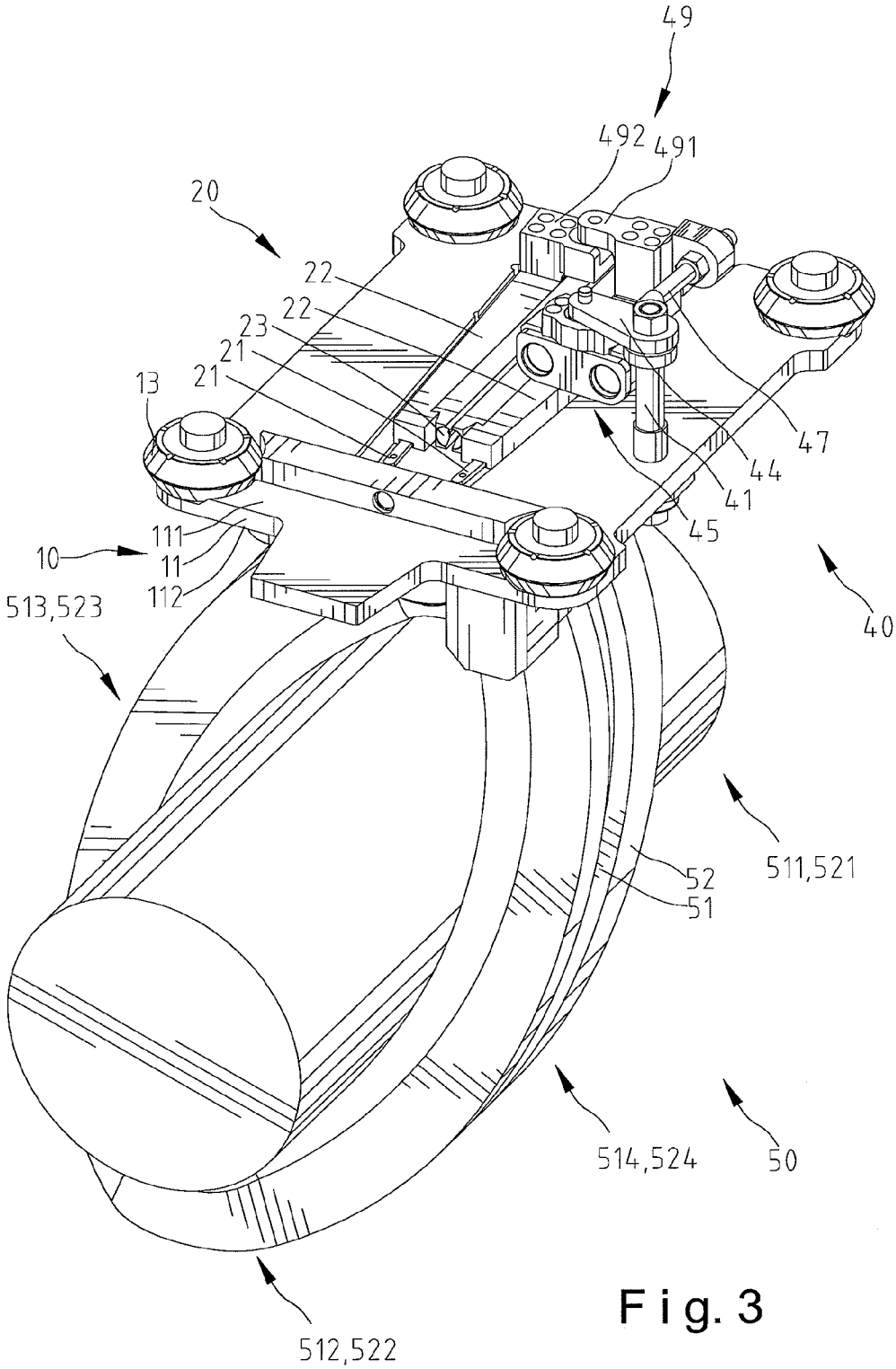
FIG. 3 is a perspective view of combination of a cam and the drawing machine shown in FIG. 1.

Referring to FIGS. 1 through 4, there is shown a drawing machine according to the preferred embodiment of the present invention. The drawing machine includes a plate unit 10. The plate unit 10 consists of first and second plates 11 and 12, four guiding rollers 13 and two guiding rails 14. The guiding rollers 13 are provided to connect four corners of first plate 11 to four corners of second plate 12, respectively, and space the first plate 11 from the second plate 12. The guiding rails 14 are installed to two sides of the first and second plates 11 and 12. Two of the guiding rollers 13 are limited to reciprocate in one of the guiding rails 14, and the other two of the guiding rollers 13 are limited to reciprocate in another guiding rail 14. The first plate 11 has first and second surfaces 111 and 112. The second plate 12 has first and second surfaces 121 and 122, with the second surface 122 of the second plate 12 adjacent to the first surface 111 of the first plate 11.

A clamping device 20 is installed onto the first surface 111 of the first plate 11 (shown in FIG. 3, with the second plate 12 being concealed) and used to clamp a rod or pipe to be drawn. A transmit member 30 is pivotally installed onto the second surface 112 of the first plate 11. A driving device 40 is inserted through the first and second plates 11 and 12 of the plate unit 10 and in communication with the clamping device 20 and the transmit member 30 for allowing the clamping device 20 to clamp or release a rod or pipe alternatively.

First and second guide members 15 and 16 are provided on the second surface 112 of the first plate 11 and disposed on two sides of the transmit member 30. A cam 50 which is parallel to the plate unit 10 limits the transmit member 30 thereon. The first and second guide members 15 and 16 roll with respect to the first plate 11 and abut against two sides of the cam 50.

The clamping device 20 includes two rails 21 extending on the first surface 111 of the first plate 11 of the plate unit 10, two upper slides 22 movably mounted on the rails 21 respectively and two jaws 23 carried on the upper slides 22 respectively. Each rail 21 includes a first end and a second end, with two rails 21 getting closer to one another from the first ends thereof to the second ends thereof. The rod or pipe is received between the jaws 23.

Figure 4:
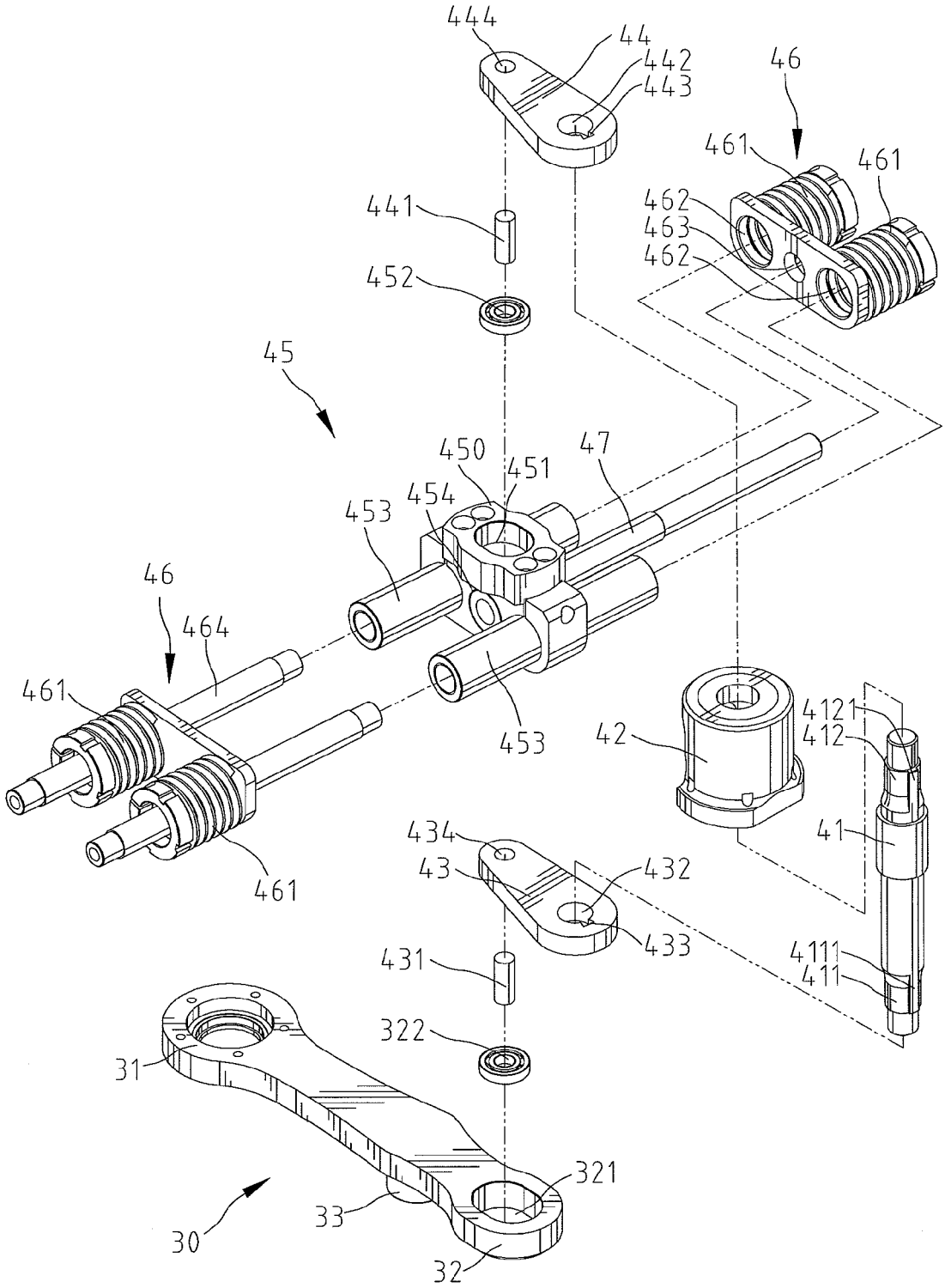
FIG. 4 is a partial, exploded view of the drawing machine shown in FIG. 1.

As shown in FIG. 4, the transmit member 30 includes first and second ends 31 and 32, with the first end 31 pivotally connected to the second surface 112 of the first plate 11. The second end 32 of the transmit member 30 includes a long hole 321, and a bearing 322 is disposed in the hole 321 and connected to the driving device 40. A following roller 33 is attached onto the transmit member 30 between the first and second ends 31 and 32, with the following roller 33 being adjacent to the second end 32 and away from the first end 31. The following roller 33 is limited on and moves with respect to the cam 50.

The driving device 40 includes a main linkage 41, a base portion 42, active and passive cranks 43 and 44, a pin-jointed unit 45, two cushion units 46, a push element 47, four fixed elements 48 disposed on the first surface 121 of the second plate 12 and a fixed based member 49 fixed to the upper slides 22 of the clamping device 20. The main linkage 41 which has first and second end 411 and 412 is inserted through the first and second plates 11 and 12 of the plate unit 10 and freely rotates with respect to the plate unit 10. The base portion 42 is mounted on the main linkage 41 between the first and second ends 411 and 412 and fixed on the first surface 121 of the second plate 12. The active and passive cranks 43, 44 have first and second apertures 432 and 434, 442 and 444 respectively formed on two ends thereof and fixed portions 433, 443 extending from the periphery of the first apertures 432, 442 as to form the first apertures 432, 442 to be non-circular. The first and second ends 411 and 412 respectively have fixed portions 4111, 4121 formed thereon. The first end 411 of the main linkage 41 is inserted through the first aperture 432 of the active crank 43, and the fixed portion 4111 is adapted to engage with the fixed portion 433 of the active crank 43 as to fix the active crank 43 to the first end 411 of the main linkage 41. The second end 412 of the main linkage 41 is inserted through the first aperture 442 of the passive crank 44, and the fixed portion 4121 is adapted to engage with the fixed portion 443 of the passive crank 44 as to fix the passive crank 44 to the second end 412 of the main linkage 41. Therefore, the active and passive cranks 43 and 44 do not rotate relative to the main linkage 41. Further, the passive crank 44 is abutted with the top of the base portion 42.

The pin-jointed unit 45 includes a main body 450, a long hole 451 longitudinally pre-penetrated in the main body 450, a bearing 452 disposed in the hole 451, two columns 453 transversely inserted through two sides of the main body 450 and a receiving hole 454 provided between the columns 453. An end of the push element 47 is fixed in the receiving hole 454, with the push element 47 being in a form of a shaft.

The active crank 43 is pivotally connected to the transmit member 30 via a fastening pin 431 coupled to the second aperture 434 and the bearing 322 of the second end 32 of the transmit member 30. The passive crank 44 is pivotally connected to the pin-jointed unit 45 via a fastening pin 441 coupled to the second aperture 444 and the bearing 452 of the hole 451 of the pin-jointed unit 45.

Two cushion units 46 are installed to the columns 453. Each cushion unit 46 has two connecting portions 461 and a through-hole 462 provided through each connecting portion 461. Two rods 464 are respectively inserted through the through-holes 462 of one of the cushion units 46, the columns 453 and the through-holes 462 of another cushion unit 46 in sequence. One of the cushion units 46 has an orifice 463, with another end of the push element 47 inserted through the orifice 463. Two ends of each rod 464 are fixed to the fixed elements 48 as to fix the pin-jointed unit 45, the cushion units 46 and the push element 47 between the fixed elements 48.

The fixed base member 49 includes first and second bases 491 and 492, with the first base 491 fixed to one of the upper slides 22 and the second base 492 fixed to another upper slide 22. The first and second bases 491 and 492 are coupled to each other slidably. The push element 47 which is inserted through the orifice 463 of the one cushion unit 46 is fixed to the first base 491 of the fixed base member 49 as to drive the fixed base member 49 to move with the push element 47.

The active crank 43 drives the main linkage 41 to rotate as to drive the passive crank 44 to pivot with respect to the main linkage 41. Then, the pin-jointed unit 45 is driven to reciprocate with respect to the passive crank 44 transversely and pushes the cushion units 46. Hence, the push element 47 moves by the transverse reciprocation of the pin-jointed unit 45 to drive the fixed base member 49. Moreover, the cushion units 46 are provided to the clamping device 20 for protection and prevent the clamping device 20 from becoming tightly wedged during clamping.

The cam 50 includes a first cam path 51 defined therein and a second cam path 52 extending thereon. The first cam path 51 is sunk on the second cam path 52. The first cam path 51 has first and second ends 511 and 512, and the second cam path 52 has first and second ends 521 and 522. The following roller 33 of the transmit member 30 is movable in and along the first cam path 51 so that the following roller 33 rectilinearly moves when the cam 50 rotates. The first and second guide members 15 and 16 are provided on two sides of the second cam path 52.

Figure 5:
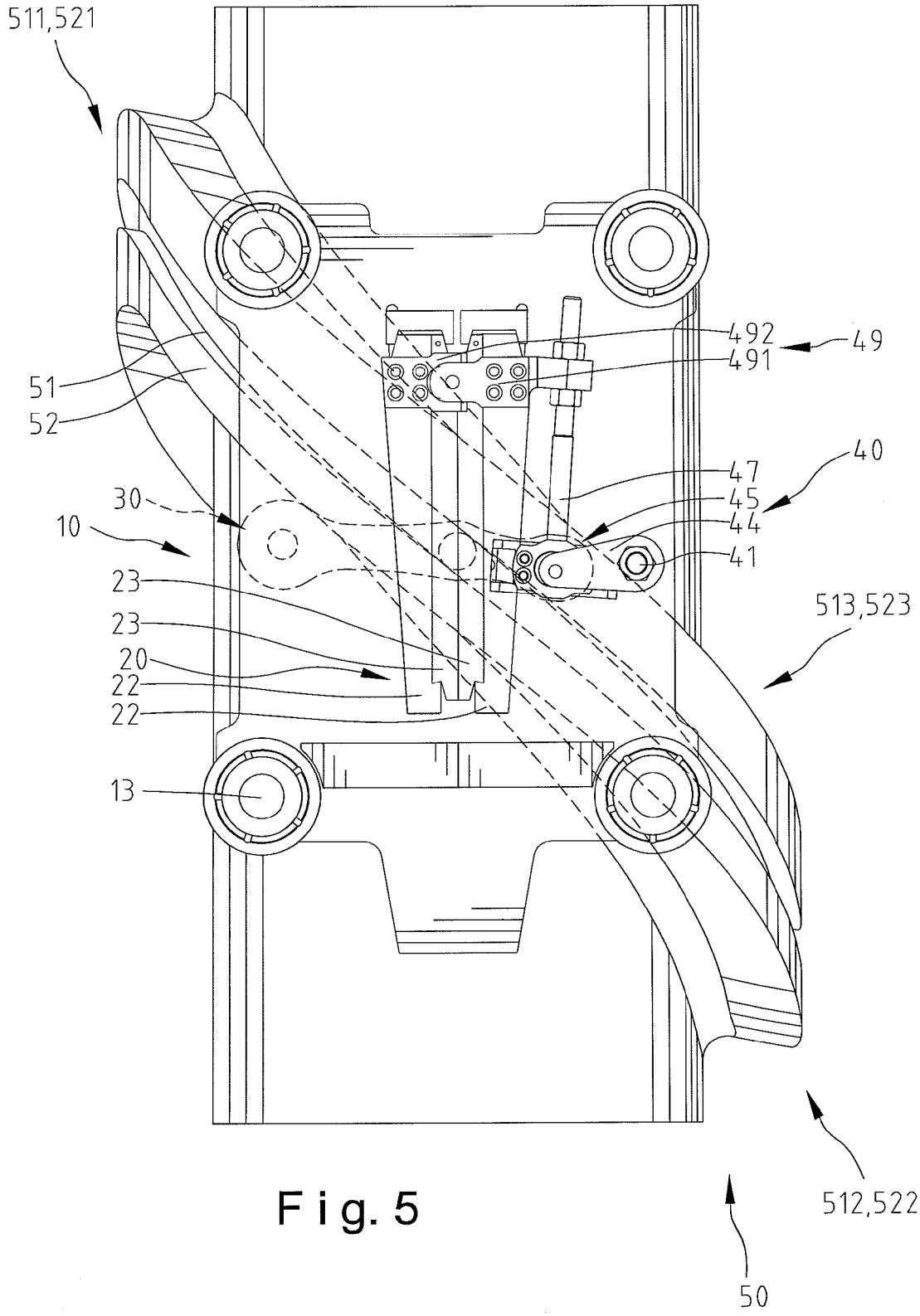
FIG. 5 is a top view of the cam and the drawing machine shown in FIG. 1.
Figure 6:
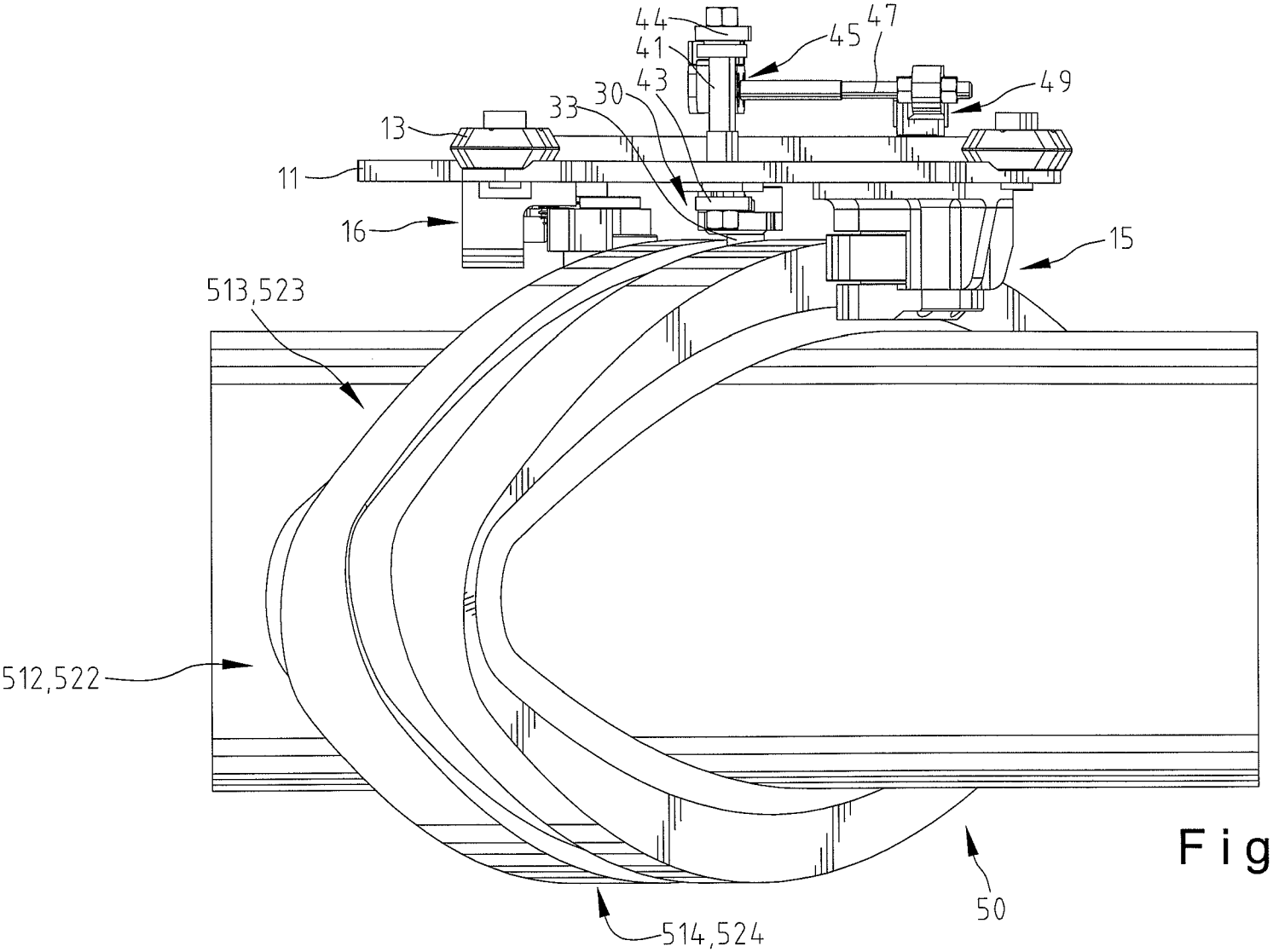
FIG. 6 is a side view of the cam and the drawing machine shown in FIG. 1.
Figure 7:
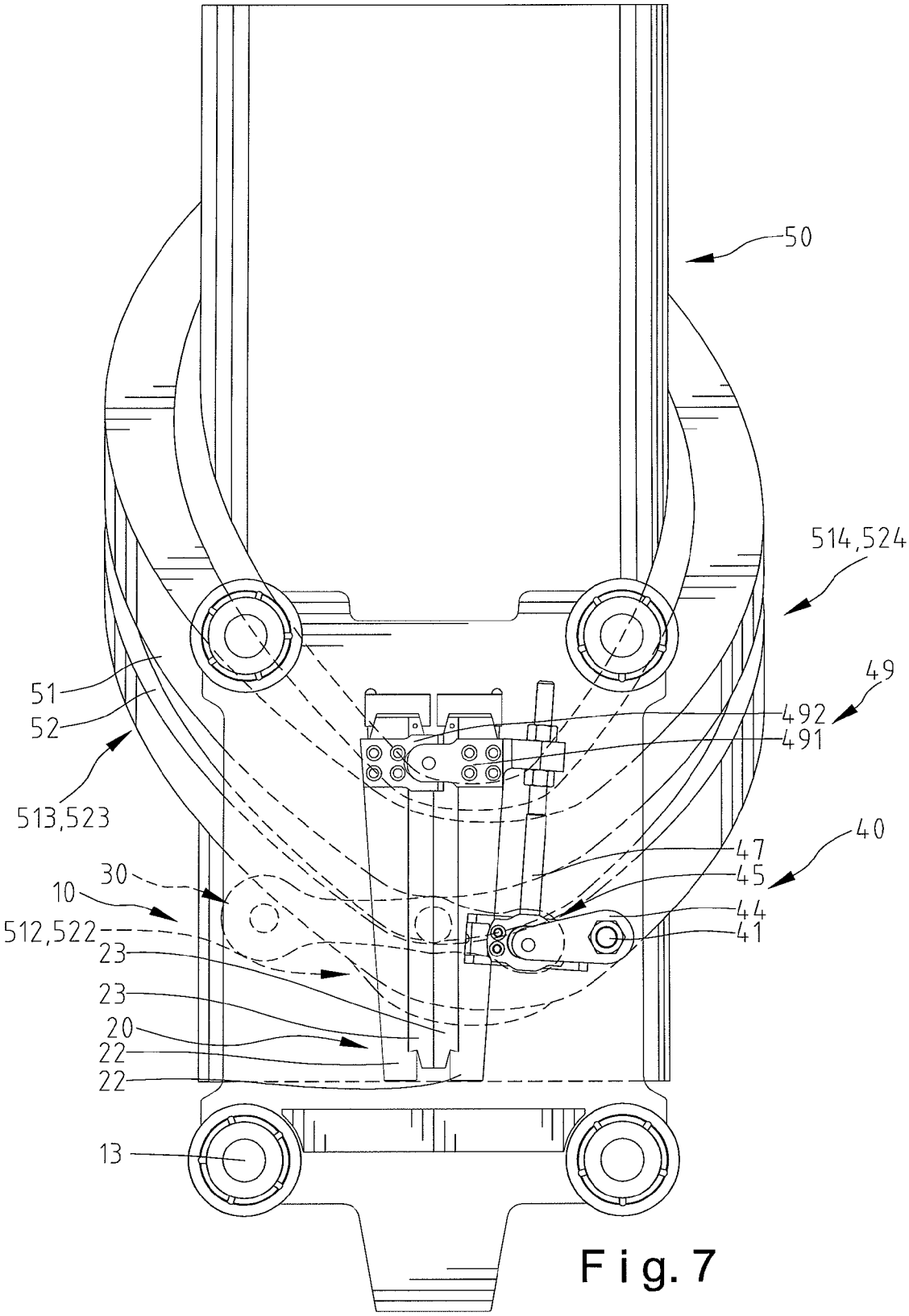
FIG. 7 is another top view of the cam and the drawing machine similar to FIG. 5.

The first cam path 51 and the second cam path 52 respectively include clamping sections 513, 523 and releasing sections 514, 524. When the following roller 33 of the transmit member 30 is provided on the clamping section 513 of the first cam path 51 as in a first position and the first and second guide members 15 and 16 are provided to engage with two sides of the clamping section 523 of the second cam path 52, the distance between the first guide member 15 and the following roller 33 of the transmit member 30 is different from the distance between the second guide member 16 and the following roller 33 of the transmit member 30. When the following roller 33 of the transmit member 30 is provided on the releasing section 514 of the first cam path 51 as in a second position and the first and second guide members 15 and 16 are provided to engage with two sides of the releasing section 524 of the second cam path 52, the distance between the first guide member 15 and the following roller 33 of the transmit member 30 is equal to the distance between the second guide member 16 and the following roller 33 of the transmit member 30 (shown in FIGS. 5 though 7).

While the cam 50 rotates, the following roller 33 of the transmit member 30 is disposed in the clamping section 513, and the first and second guide members 15 and 16 abut with two sides of the clamping section 523 as to drive the transmit member 30 to move with respect to the plate unit 10 reciprocatingly. Then, the following roller 33 of the transmit member 30 slides along the first cam path 51.

When the transmit member 30 moves with respect to the plate unit 10 reciprocatingly, the active crank 43 is driven to pivot and drives the passive crank 44 to pivot, with the active and passive cranks 43 and 44 being driven toward the second ends 512, 522 of the first and second cam paths 51 and 52. The pin-jointed unit 45 is driven by the passive crank 44 to push the cushion units 46 and drives the push element 47 to push the fixed base member 49. Hence, the first and second bases 491 and 492 of the fixed base member 49 is driven to force the upper slides 22 of the clamping device 20 to move toward the second ends 512, 522 of the first and second cam paths 51 and 52 as to let the jaws 23 get closer to each other for clamping the rod or pipe (as shown in FIG. 1).

Figure 8:
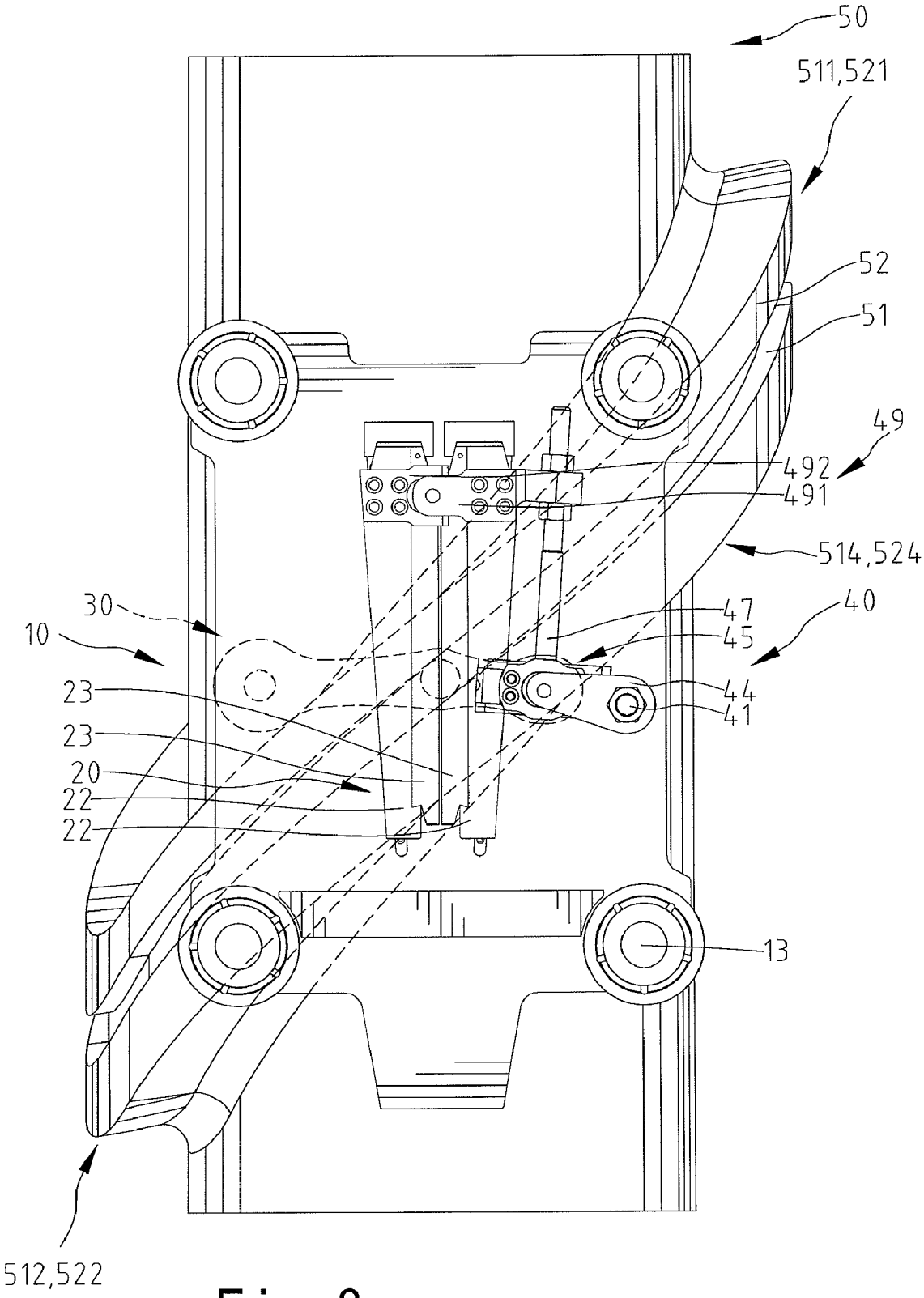
FIG. 8 is a top view of the drawing machine in another position than shown in FIG. 5.
Figure 9:
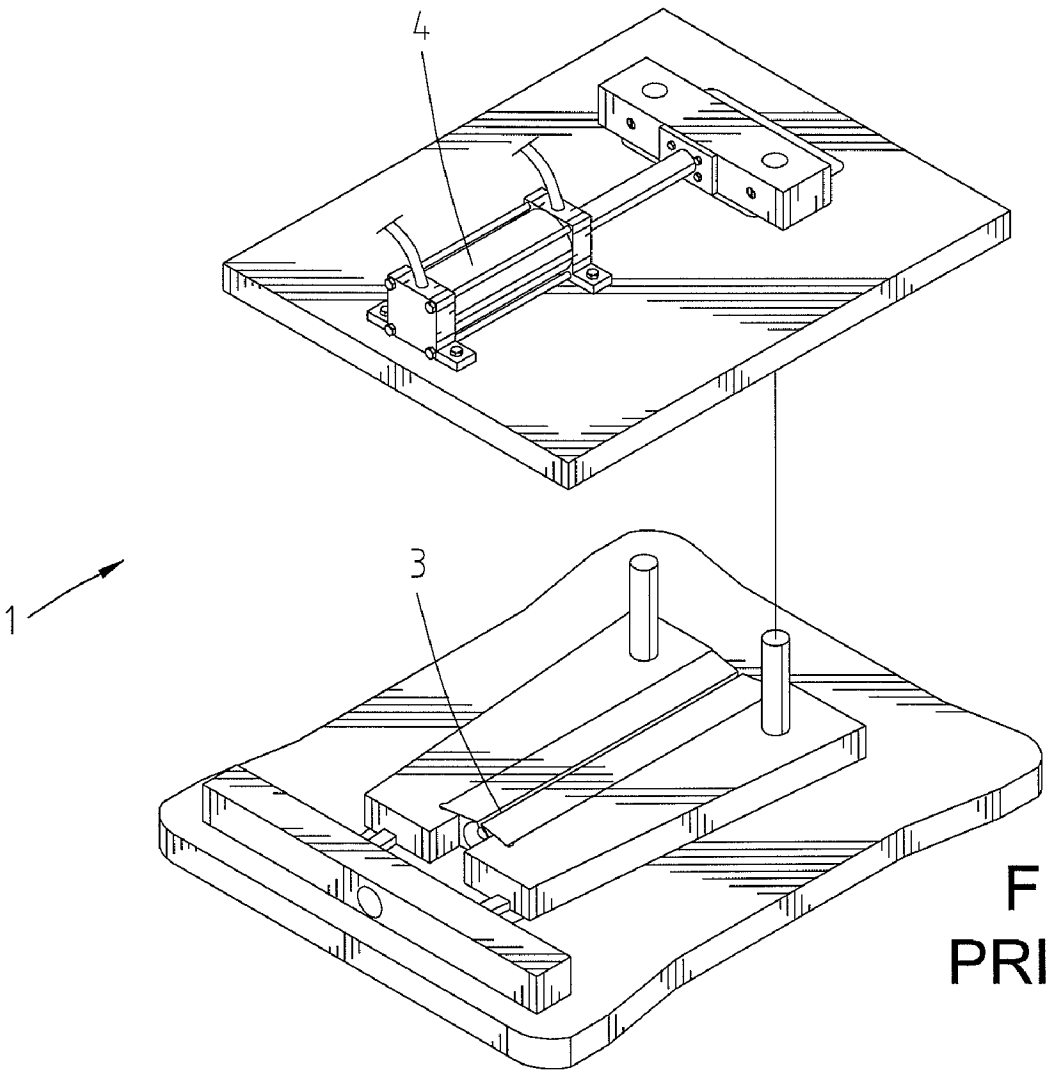
Fig. 9 PRIOR ART
FIG. 9 is an exploded view of a conventional drawing machine.
Figure 10:
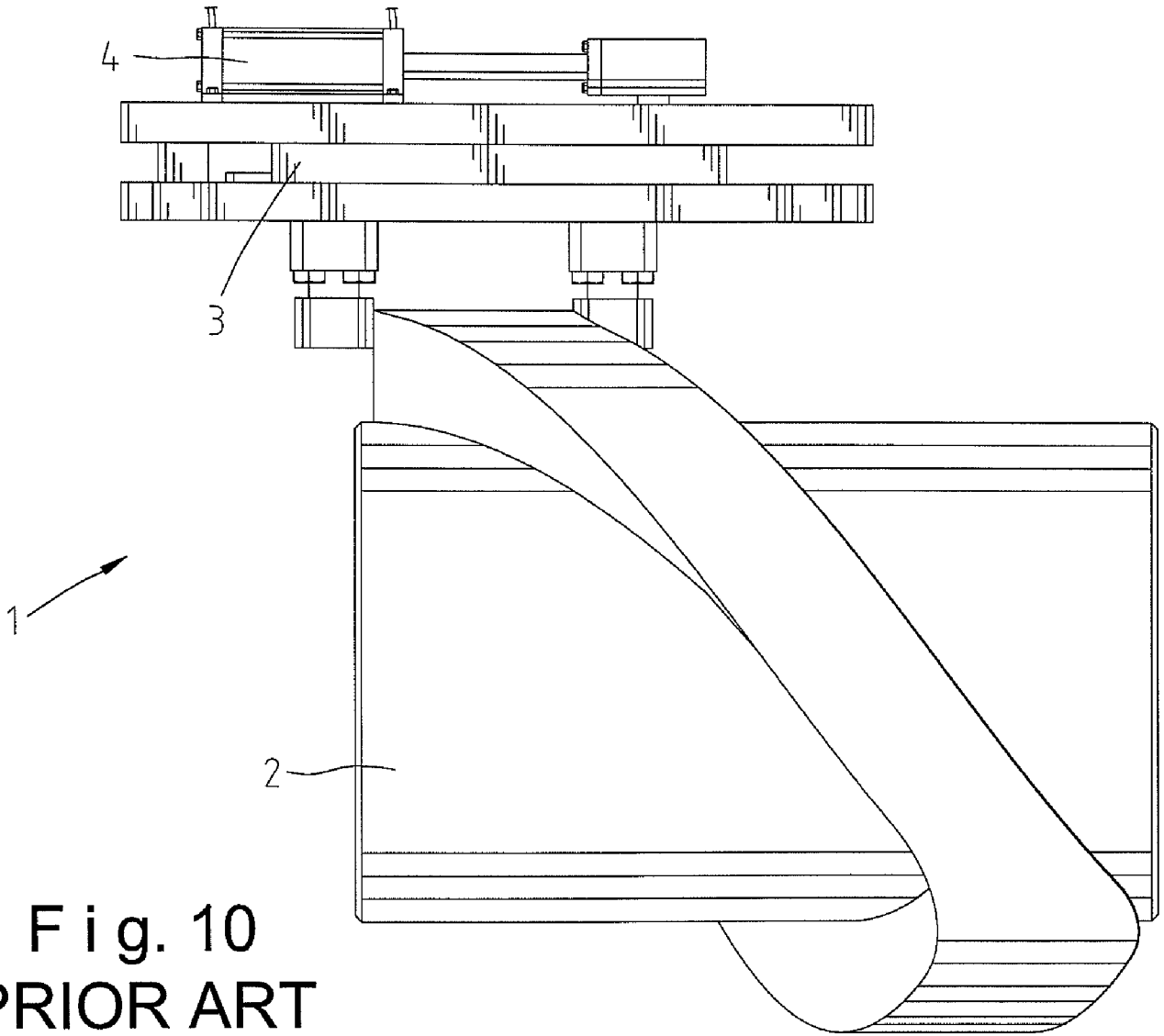
Fig. 10 PRIOR ART
FIG. 10 is a side view of a clamping device of the conventional drawing machine shown in FIG. 9.

Referring to FIG. 8, the cam 50 continues to rotate, and the following roller 33 of the transmit member 30 passes through the first end 512 of the first cam path 51 to enter the releasing section 514. At this moment, the first and second guide members 15 and 16 abut with two sides of the releasing section 524, with the first cam path 51 being on the midpoint of the second cam path 52.

When the transmit member 30 moves with respect to the plate unit 10 reciprocatingly, the active crank 43 is driven to pivot and drives the passive crank 44 to pivot, with the active and passive cranks 43 and 44 being driven toward the first ends 511, 521 of the first and second cam paths 51 and 52. The pin-jointed unit 45 is driven by the passive crank 44 to push the cushion units 46 and drives the push element 47 to push the fixed base member 49. Hence, the first and second bases 91 and 92 of the fixed base member 49 is driven to enforce the upper slides 22 of the clamping device 20 to move toward the first ends 511, 521 of the first and second cam paths 51 and 52 as to separate the jaws 23 from each other. Therefore, the jaws 23 can not clamp the rod or pipe.

An advantage of the drawing machine according to the present invention is reliability for not including any hydraulic or pneumatic cylinder that fluctuates in the pressure of the fluid and drags in transmission of the fluid. Another advantage of the drawing machine according to the present invention is a simple structure including a small amount of elements.

The present invention has been described via the detailed illustration of the embodiments. Those skilled in the art can derive variations from the embodiments without departing from the scope of the present invention. Therefore, the embodiments shall not limit the scope of the present invention defined in the claims.

What is claimed is:

1. A drawing machine comprising:

a first plate having first and second surfaces;

a clamping device installed on the first surface of the first plate;

a transmit member including first and second ends;

a following roller rotatably mounted to the transmit member between the first and second ends, with the first end of the transmit member pivotally connected to the second surface of the first plate about a first pivot axis perpendicular to the second surface of the first plate, with the following roller rotating about a rotatable axis parallel to and spaced from the first pivot axis;

a driving device interconnecting the second end of the transmit member and the clamping device; wherein the transmit member pivots with respect to the driving device; wherein the driving device moves reciprocatingly with respect to the first plate; and a cam including a first cam path and a second cam path, with the first cam path disposed between two sides of the second cam path;

wherein the following roller is located in the first path, with the cam movable relative to the following roller between a first position and a second position, wherein when the cam is in the first position, the distances between the following roller located in the first cam path and the two sides of the second cam path are different; wherein when the cam is in the second position, the distances between the following roller located in the first cam path and the two sides of the second cam path are equal;

with the second end of the transmit member driving the driving device so that the clamping device is driven to clamp a rod or pipe, and with the first plate driven by the second cam path for reciprocating along the cam axially.

2. The drawing machine as claimed in claim 1, wherein the driving device further comprises a main linkage having first and second ends and rotatable about a second pivot axis, an active crank fixed to the first end of the main linkage and pivotally connected about a third pivot axis to the second end of the transmit member, with the second and third pivot axes being spaced and parallel and spaced and parallel to the first pivot axis, a passive crank fixed to the second end of the main linkage, a pin-jointed unit pivotally connected to the passive crank, a push element fixed to the pin-jointed unit and a fixed base member respectively fixed to the push element and the clamping device.

3. The drawing machine as claimed in claim 2, with the passive crank driving the pin-jointed unit to move reciprocatingly with respect to the first plate.

4. The drawing machine as claimed in claim 2, further comprising two columns transversely inserted though two sides of the pin-jointed unit and two cushion units installed to the two columns, with the push element inserted though one of the two cushion units to fix to the fixed base member.

5. The drawing machine as claimed in claim 4, further comprising a second plate connected to the first plate of the plate unit via guiding rollers and four fixed elements respectively fixed to two ends of each cushion unit and a base portion fixed on the second plate and mounted on the main linkage for supporting the passive crank, with the four fixed elements installed to the second plate.

6. The drawing machine as claimed in claim 5, further comprising two guiding rails provided on two sides of the first plate with respect to the guiding rollers, with the guiding rollers limited to reciprocate in the two guiding rails.

7. The drawing machine as claimed in claim 2, with the fixed base member movable relative to the first plate and including first and second bases coupled to each other slidably, with the first and second bases respectively connected to the clamping device, with the push element fixed to one of the first and second bases.

8. The drawing machine as claimed in claim 1, further comprising first and second guide members fixed on the second surface of the first plate, with the first and second guide members engaging with the two sides of the second cam path, with the first cam path located intermediate the first and second guide members.

9. The drawing machine as claimed in claim 1, wherein the clamping device further comprises two rails extending on the first surface of the first plate of the plate unit, two upper slides movably mounted on the rails respectively and two jaws carried on the upper slides respectively.

10. A drawing machine comprising:

a first plate having first and second surfaces;

a clamping device installed on the first surface of the first plate;

a transmit member including first and second ends;

a following roller rotatably mounted to the transmit member between the first and second ends, with the first end of the transmit member pivotally connected to the second surface of the first plate about a first pivot axis perpendicular to the second surface of the first plate, with the following roller rotating about a rotatable axis parallel to and spaced from the first pivot axis;

a driving device including a main linkage, active and passive cranks, a pin-jointed unit, a push element and a fixed base member;

wherein the main linkage has first and second ends, with the first end of the main linkage fixed to the active crank, with the active crank pivotally connected to the second end of the transmit member, with the second end of the main linkage fixed to the passive crank, with the passive crank pivotally connected to the pin-jointed unit, with the pin-jointed unit fixed to the push element, with the push element fixed to the fixed base member, and with the fixed base member fixed to the clamping device;

wherein the transmit member pivots with respect to the active crank, wherein the passive crank pivots to drive the pin-jointed unit to move reciprocatingly with respect to the first plate; and a cam including a first cam path and a second cam path, with the first cam path disposed between two sides of the second cam path;

wherein the following roller is located in the first path, with the cam movable relative to the following roller between a first position and a second position, wherein when the cam is in the first position, the distances between the following roller located in the first cam path and the two sides of the second cam path are different; wherein when the cam is in the second position, the distances between the following roller located in the first cam path and the two sides of the second cam path are equal;

with the second end of the transmit member driving the main linkage to pivot, with the clamping device driven to clamp a rod or pipe, and with the first plate driven by the second cam path for reciprocating along the cam axially.

11. The drawing machine as claimed in claim 10, with the second end of the transmit member having a long hole, a bearing disposed in the long hole of the second end of the transmit member, and a fastener pin located in the bearing and coupled to the active crank.

12. The drawing machine as claimed in claim 10, with the pin-jointed unit including a main body, a long hole longitudinally formed in the main body, a bearing disposed in the long hole of the pin-jointed unit and a fastener pin located in the bearing and coupled to the passive crank.

13. The drawing machine as claimed in claim 10, further comprising two columns transversely inserted through two sides of the pin-jointed unit and two cushion units installed to the two columns, with the push element inserted though one of the two cushion units to fix to the fixed base member.

14. The drawing machine as claimed in claim 13, further comprising a second plate connected to the first plate of the plate unit via guiding rollers and four fixed elements respectively fixed to two ends of each cushion unit, with the four fixed elements installed to the second plate.

15. The drawing machine as claimed in claim 14, further comprising a base portion fixed on the second plate and mounted on the main linkage for supporting the passive crank.

16. The drawing machine as claimed in claim 14, further comprising two guiding rails provided on two sides of the first plate with respect to the guiding rollers, with the guiding rollers limited to reciprocate in the two guiding rails.

17. The drawing machine as claimed in claim 10, with the fixed base member movable relative to the first plate and including first and second bases coupled to each other slidably, with the first and second bases respectively connected to the clamping device, with the push element fixed to one of the first and second bases.

18. The drawing machine as claimed in claim 10, further comprising first and second guide members fixed on the second surface of the first plate, with the first and second guide members engaging with the two sides of the second cam path, with the first cam path located intermediate the first and second guide members.

19. The drawing machine as claimed in claim 10, wherein the clamping device further comprises two rails extending on the first surface of the first plate of the plate unit, two upper slides movably mounted on the rails respectively and two jaws carried on the upper slides respectively.

20. The drawing machine as claimed in claim 10, wherein the main linkage is rotatable about a second pivot axis, with the active crank pivotally connected about a third pivot axis to the second end of the transmit member, with the second and third pivot axes being spaced and parallel and spaced and parallel to the first pivot axis.

* * * * *